US005816179A

United States Patent [19]

Winner

[11] Patent Number: 5,816,179

[45] Date of Patent: Oct. 6, 1998

[54] ANTI-VENTILATION DEVICE FOR SAILBOARDS

[76] Inventor: William K. Winner, P.O. Box 1127, White Salmon, Wash. 98672

[21] Appl. No.: 16,780

[22] Filed: Jan. 30, 1998

[51] Int. Cl.[6] ..... B63B 35/79

[52] U.S. Cl. ..... 114/39.2; 441/79

[58] Field of Search ..... 441/65, 68, 74, 441/75, 79; 114/39.1, 39.2, 127, 140

[56] References Cited

U.S. PATENT DOCUMENTS 3,988,794 11/1976 Tinkler et al. ..... 441/74

4,649,847 3/1987 Tinkler et al. ..... 114/39.2

5,209,686 5/1993 Namur ..... 441/79

5,683,280 11/1997 Winner ..... 441/79

*Primary Examiner*—Stephen Avila

*Attorney, Agent, or Firm*—Flehr Hohbach Test Albritton & Herbert LLP

[57] ABSTRACT

An improved sailboard (10) including a hull (12) with a fin (20) secured at the rear thereof, a flexible skirt (24) secured to the hull (12) and extending aft of the fin (20), and a rear extension (29) of the hull that extends aft of the skirt (24). The tail edge (16) of the hull (12) wraps around fin (20) and is cut forward so that the skirt (24) extends laterally of the fin (20).

5 Claims, 1 Drawing Sheet

ANTI-VENTILATION DEVICE FOR SAILBOARDS

TECHNICAL FIELD

The present invention relates to sailboards and, more particularly, to an improved tail section design for a sailboard.

BACKGROUND ART

My prior U.S. Pat. No. 5,683,280 discloses an anti-ventilation device in the form of a flexible skirt that extends aft of the fin of a sailboard of the type used by windsurfers. The skirt extends aft of the fin so that it covers the area immediately behind the tail edge of the fin. As a result, the area around the fin is occupied by either the hull or the skirt, which together act as a barrier to air getting drawn down past the fin. The skirt is strong enough to prevent ventilation in the area around the fin, yet has sufficient flexibility to assume the contour of the waterline as the pitch of the sailboard changes. By assuming the contour of the waterline, the skirt does not directly influence the pitch or direction of the sailboard. Provision of the skirt immediately around the fin allows for positioning of the fin further back of the hull of the sailboard, which has the advantage of increasing sailboard performance.

The present invention is an improvement upon the anti-ventilation skirt disclosed in my '280 patent.

DISCLOSURE OF INVENTION

Briefly described, the present invention comprises a sailboard for sailing across a body of water, including a hull having a tail section, with the tail section having a tail edge defining a planing surface for contacting the surface of the water, a fin mounted to the hull at the tail section in close proximity to the tail edge, and a skirt mounted to the hull and extending aft of the fin. The skirt is flexible so that it assumes the contour of the waterline as the pitch of the sailboard changes, but has sufficient strength to prevent ventilation in the region of the fin. The hull further includes an upper deck surface for positioning of the feet of a person, with the deck surface extending aft of the planing surface. By extending the upper deck aft of the skirt, board volume is increase and the rails of the board are extended further back, lengthening the rail that is in the water during a turn.

According to an aspect of the invention, the side rails of the upper deck may be sufficiently low relative to the planing surface of the board to contact the water during a jibe maneuver. This has the advantage of increasing jibing performance in some circumstances, such as in rough water conditions. Preferably, the side rails of the upper deck continue the rail line of the hull and extend aft of the skirt.

According to an aspect of the invention, the tail edge of the hull wraps around the tail edge of the fin and progressively diverges toward the side rails of the hull. In other words, an apex is formed around the fin to form a cut-away tail edge, which has the effect of shortening the wetted surface of the hull and thereby decreasing drag resistance of the hull. With a cut-away tail edge, the skirt wraps around the tail edge of the hull in the area immediately laterally adjacent the fin.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
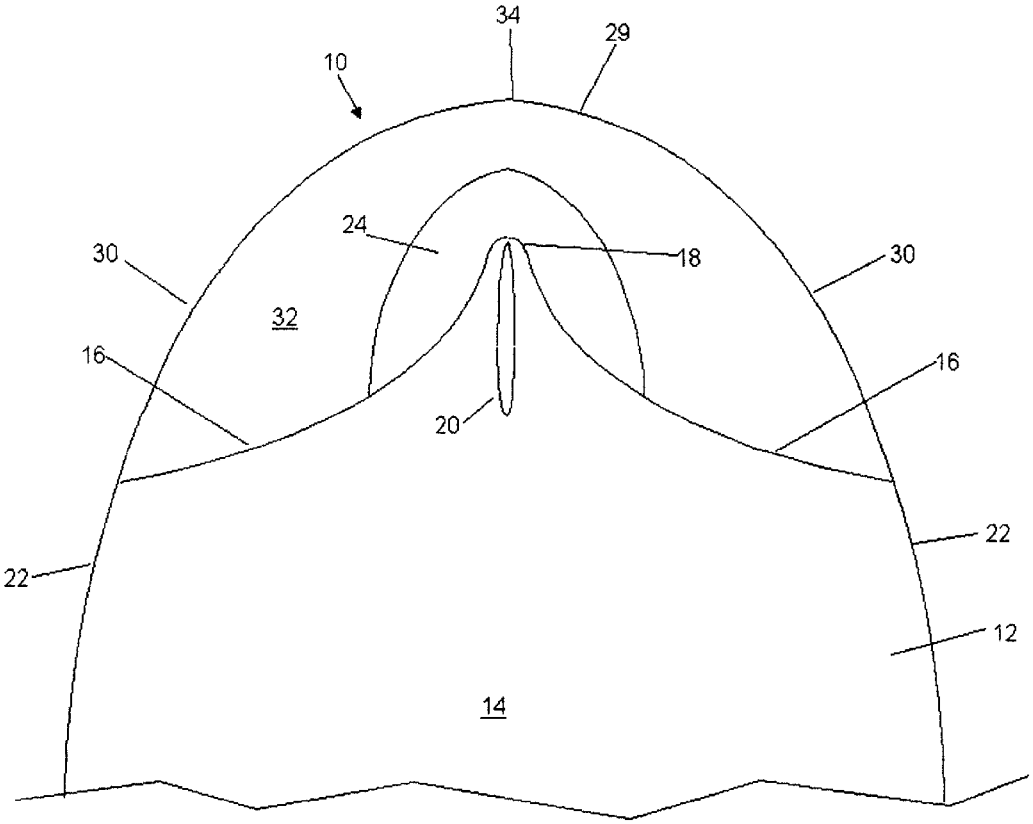
FIG. 1 is a bottom view of the tail section of a sailboard of the present invention.
Figure 2:
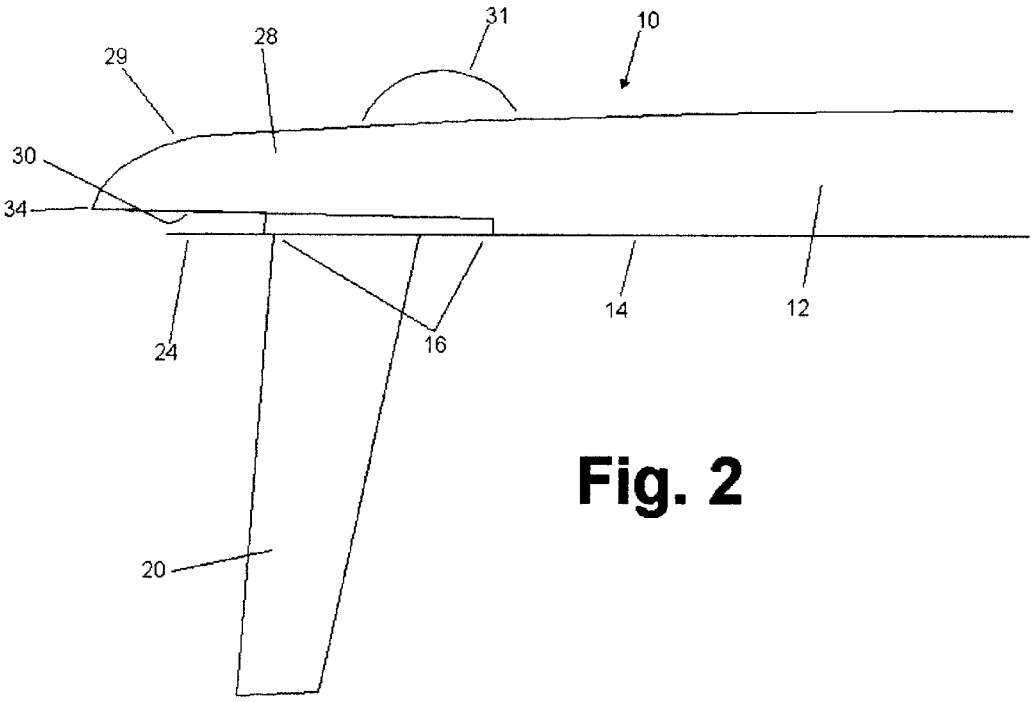
FIG. 2 is a side elevation view of the tail section of FIG. 1.

FIGS. 1 and 2 show a bottom plan view and a side elevation view, respectively, of the tail section 10 of a windsurfing sailboard hull 12. The hull is sometimes referred to herein as the "board" or "sailboard." The planing surface 14 of hull 12 has its rear edge defined by a tail edge 16 of the bottom of the hull. Tail edge 16 can take many shapes, but preferably converges to an apex 18, which defines the aft most area of the planing surface of hull 12. Alternatively, tail edge 16 could be formed as a straight edge or V-shaped design.

A fin 20 is secured to hull 12 in the area of apex 18. From apex 18, it can be said that tail edge 16 progressively diverges outwardly from fin 20 and toward the side rails 22 of hull 12 to form a somewhat cut-away tail edge. This cut-away design has the advantage of minimizing the wetted surface of the hull, while maintaining sufficient planing surface. Conceivably, tail edge 16 could be cut farther forward of fin 20 and, as mentioned, could be a straight across tail edge, or various other designs.

For a forward cut tail edge of the type shown, it is necessary to provide additional structural reinforcement to the hull in and around apex 18 in order to adequately secure fin 20 to the hull. Preferably, additional carbon fiber reinforcement is provided.

A flexible skirt 24 is secured to hull 12 around tail edge 16 and in the area around apex 18. Skirt 24 can be made of a variety of materials, such as for example mylar, plastic, rubber, or polyurythane. Skirt 24 extends aft of fin 20 and is coplanar with the bottom surface of hull 12. Because of the cut-away design of the tail edge, skirt 24 extends laterally of the fin, in order to ensure that an area of approximately 1.5–3.0 inch radius extends around the fin. In this manner, skirt 24 continues the bottom surface of the hull around the fin, which extends the wetted surface rearwardly around the fin, but does not extend the planing surface of the hull. As discussed in more detail in my '280 patent, skirt 24 has sufficient strength to prevent ventilation in the region behind and to the sides of fin 20, yet has sufficient flexibility so that it does not influence the position of hull 12 in response to forces of the water.

Hull 12 includes an upper deck region 28 with an upper surface on which a person stands with his or her feet supported on the upper deck region, with the feet inserted into foot straps, like foot strap 31. Upper deck region 28 includes a rear extension 29 extends aft of fin 24 and includes side rails 30 that continue the rail line of the side rails 22 of hull 12. The under surface 32 of rear extension 29 is above skirt 24 and, thus, above the bottom surface 14 of hull 12. However, under surface 32 is low enough relative to the water so that during a jibing maneuver, side rails 30 may enter the water and influence the maneuvering of the hull, thus improving jibing performance by lengthening the rail of the board that is in the water during a turn.

The tail edge 34 of rear extension 29 extends aft of skirt 24, preferably to approximately ½ to 1 inch behind the skirt, but could conceivably extend much further aft of the skirt. It is desirable to position the rear edge of fin 20 as close as possible to tail apex 18, preferably within ¼ inch. The further back the fin can be placed, the lower the amount of the wetted surface of the hull, which results in decreased drag.

The tail edge 16 of hull 12 is cut forward around fin 20 in order to decrease the wetted surface area, or planing surface, of the hull. This also has the advantage of decreasing drag resistance by reducing the wetted surface of the hull, which increases board speed and improves planing performance.

The provision of rear extension 29 above and to the rear or aft of skirt 24 has the advantage of increasing the volume of the hull, which increases flotation and stability of the board. It also provides additional stepping area on which a person can support themselves, which diminishes the possibility of a person stepping off the back of the board and possibly cutting their foot on the fin.

Rear extension 29 also affects the pitch of the board. When the nose of the board rises too much, the rear extension touches the water and thereby resists further upward pitching of the board.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

What is claimed is:

1. A sailboard for sailing across a body of water, comprising a hull having a tail section, the tail section having a tail edge defining a planing surface for contacting the surface of the water, a fin mounted to the hull at the tail section in close proximity to the tail edge, and a skirt mounted to the hull and extending aft of the fin, the skirt being flexible so that it assumes the contour of the water line as the pitch of the sailboard change, and wherein the skirt has sufficient strength to prevent ventilation of the fin, the hull further including an upper deck with a rear extension extending aft of the skirt, the rear extension being above the bottom surface of the hull so that in use the rear extension does not form part of the planing surface of the hull.

2. The sailboard of claim 1 wherein, the hull includes side rails, and wherein the rear extension includes side rails that are sufficiently low to contact the water during a jibe maneuver.

3. The sailboard of claim 2 wherein, the side rails of the rear extension continue the rail line of the rails of the hull and wherein the side rails of the rear extension extend aft of the skirt.

4. The sailboard of claim 1 wherein, the tail edge of the hull wraps around the tail edge of the fin and progressively diverges toward the side rails of the hull.

5. The sailboard of claim 4 wherein, the skirt wraps around the tail edge of the hull in the area immediately adjacent the fin.

* * * * *